US009826883B2

(12) United States Patent
Keskin et al.

(10) Patent No.: US 9,826,883 B2
(45) Date of Patent: Nov. 28, 2017

(54) HOUSEHOLD APPLIANCE WITH ADJUSTMENT MECHANISM FOR THE DOOR WEIGHT COMPENSATION DEVICE

(75) Inventors: Oguzcan Keskin, Istanbul (TR); Pelin Sari, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 1140 days.

(21) Appl. No.: 11/993,791

(22) PCT Filed: Jun. 23, 2006
(Under 37 CFR 1.47)

(86) PCT No.: PCT/IB2006/052058
§ 371 (c)(1),
(2), (4) Date: Jul. 25, 2010

(87) PCT Pub. No.: WO2006/137039
PCT Pub. Date: Dec. 28, 2006

(65) Prior Publication Data

US 2011/0215691 A1 Sep. 8, 2011

(30) Foreign Application Priority Data

Jun. 24, 2005 (TR) ..... a 2005 02466

(51) Int. Cl.
*A47B 95/00* (2006.01)
*A47L 15/42* (2006.01)
(Continued)

(52) U.S. Cl.
CPC ..... *A47L 15/4261* (2013.01); *E05F 1/1075* (2013.01); *F24C 15/023* (2013.01);
(Continued)

(58) Field of Classification Search
CPC ..... A47L 15/4261; E05D 13/1261; E05D 13/1215; E05D 13/1223; E05D 13/1269;
(Continued)

(56) References Cited

U.S. PATENT DOCUMENTS 1,000,084 A * 8/1911 Frederickson ..... 74/396
2,678,188 A * 5/1954 Rogers ..... B62D 53/065 254/359
(Continued)

FOREIGN PATENT DOCUMENTS

DE 9109818 U1 9/1992
DE 29605233 U1 8/1996
(Continued)

*Primary Examiner* — Janet M Wilkens
(74) *Attorney, Agent, or Firm* — Kilpatrick Townsend & Stockton LLP

(57) ABSTRACT

The present invention relates to a household appliance (1) such as a dishwasher or an oven, the front door (3) of which is opened by pulling from the top downwards, comprising an adjustment mechanism (5) that balances the weight of the door (3) so that while the door (3) is being opened it doesn't fall by its own weight or closed in a hard way. The adjustment mechanism (5) comprises a spring (9) that applies a tensile force on the door (3), that is pulled to be tensioned by the pulling cable (10) which is activated by an adjustment rod (6), an endless screw (7) and a gearwheel (8).

12 Claims, 4 Drawing Sheets

Figure 1:
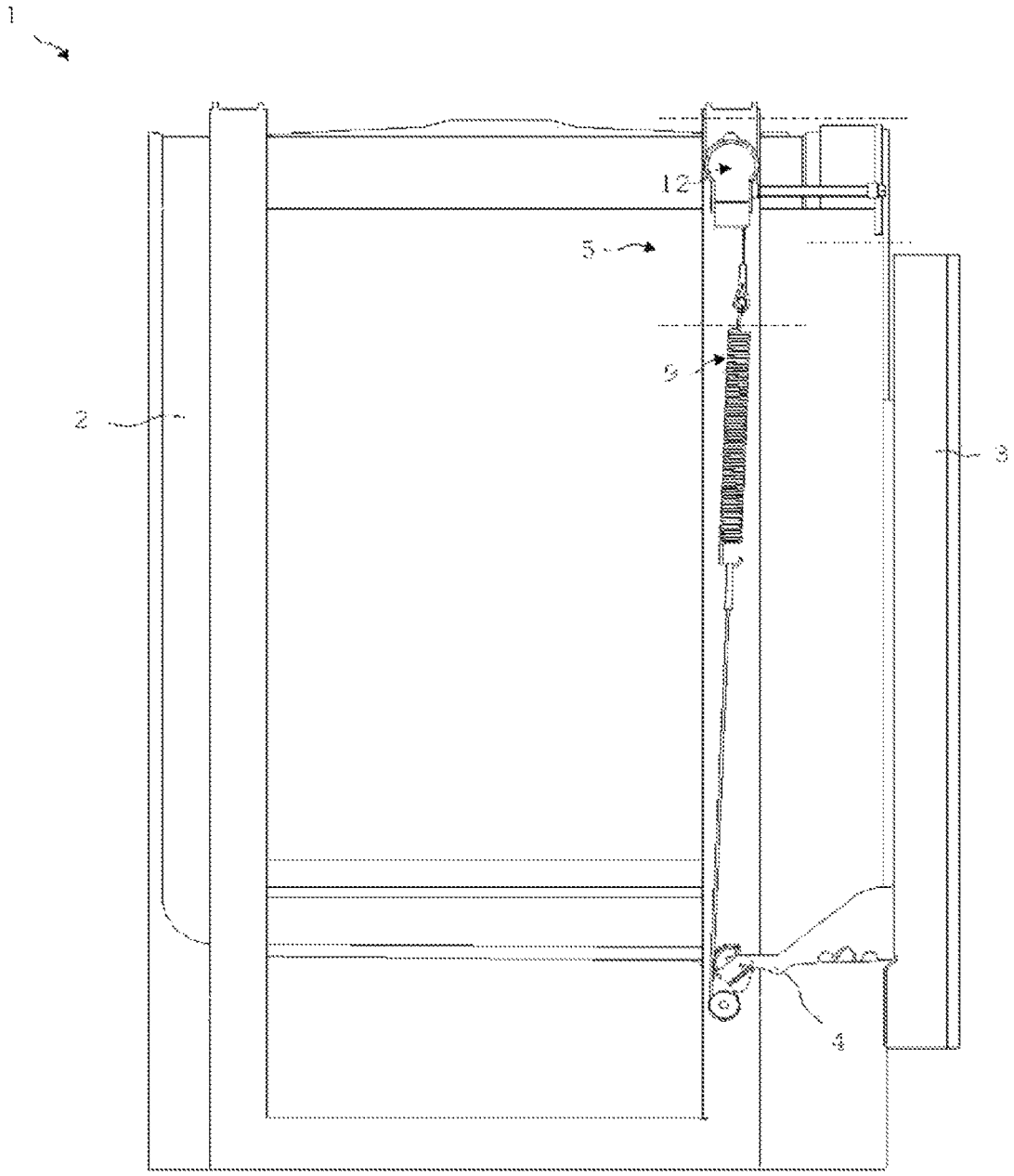

(51) Int. Cl.
*E05F 1/10* (2006.01)
*F24C 15/02* (2006.01)

(52) U.S. Cl.
CPC ..... *E05Y 2201/702* (2013.01); *E05Y 2600/20* (2013.01); *E05Y 2900/304* (2013.01); *E05Y 2900/308* (2013.01)

(58) Field of Classification Search
CPC ..... E05Y 2900/106; E05Y 2900/304; E05Y 2900/308; E05Y 2201/416; E05Y 2201/492; E05Y 2201/702; E05Y 2201/704; E06B 9/115; F24C 15/023; E05F 1/1075; E05F 1/10
USPC ..... 312/192, 319.1, 319.2, 319.4, 326, 327, 312/328, 329; 49/386, 387; 74/425; 254/343
See application file for complete search history.

(56) References Cited

U.S. PATENT DOCUMENTS 2,678,191 A * 5/1954 Jensen ..... 254/330
2,858,946 A * 11/1958 Breed ..... 212/202
3,113,566 A 12/1963 Milburn et al.
3,467,359 A * 9/1969 Durand ..... 254/340
3,788,607 A * 1/1974 Crooks ..... 254/343
3,834,670 A * 9/1974 Pityo ..... 254/338
4,019,716 A * 4/1977 Smith ..... 254/334
4,176,827 A * 12/1979 Anderson et al. ..... 254/343
4,613,273 A * 9/1986 Wagner ..... 414/463
5,615,723 A * 4/1997 Carper ..... 160/191
5,794,919 A * 8/1998 Hauck ..... 254/343
5,980,006 A * 11/1999 Wilhelmstatter et al. . 312/319.1
6,371,244 B2 * 4/2002 Okamura ..... 182/72
6,397,691 B1 * 6/2002 Greene ..... 74/89.2
6,561,254 B1 * 5/2003 Liu ..... 160/177 R
6,745,640 B2 * 6/2004 Nguyen ..... 74/425
6,761,204 B1 * 7/2004 Chou ..... 160/177 R
2003/0042825 A1 * 3/2003 Welch et al. ..... 312/228.1
2004/0099853 A1 * 5/2004 Verakis ..... 254/343
2005/0284201 A1 * 12/2005 Kachouh et al. ..... 70/416
2006/0180800 A1 * 8/2006 Tremblay ..... 254/229
2006/0273292 A1 * 12/2006 Milam ..... 254/343
2009/0314869 A1 * 12/2009 Savard ..... E05D 13/1261 242/125.1

FOREIGN PATENT DOCUMENTS

EP 0692598 A 1/1996
GB 2219623 A 12/1989

* cited by examiner

HOUSEHOLD APPLIANCE WITH ADJUSTMENT MECHANISM FOR THE DOOR WEIGHT COMPENSATION DEVICE

The present invention relates to a household appliance wherein the weight of the door is balanced by an adjustment mechanism.

In household appliances, especially in built-in devices such as the dishwasher and the oven, the outer door is mainly opened by being rotated around a horizontal axis and a spring adjustment mechanism is utilized that balances the weight of the door by applying a counterbalancing tensile force in the opposite direction of opening so that the door does not fall automatically due to the change in the position of its center of gravity. The adjustment of the tensile force that balances the door is attained more or less by the deflection of the spring through which force is provided. One end of the spring is attached to the main frame of the household appliance and stays fixed, the other end of the spring is attached to the door or a hinge that moves together with the door and when the door is opened, applies a tensile force by being deflected. In built-in products generally a decorative wooden door is mounted on the door of the household appliance and the tensile strength of the spring has to be adjusted according to the variable weight of the door. If the tensile force of the spring is not adjusted to withstand the total weight of the door and the decorative door, the door opens either too hard or falls automatically after a point. In state-of-the-art various adjustment mechanisms are utilized to balance the door of the household appliance.

In the German Patent Application no. DE 4013571, a door spring setting device for domestic dishwashing machine is described. During opening and closing, the door of the dishwasher can be balanced at any desired point between the open and shut positions by varying the fixing point of the spring on the hinge.

In the European Patent no. EP 0551234, in an electrical domestic appliance, a device (10) for counterbalancing the weight of the door compresses a spring, a first end of which is fastened to the door whilst a second end is fastened to a shaft arranged between the side walls of the appliance. The end of the spring fastened to the door is attached to an adjustment screw by way of a metal strip and the adjustment screw is rotated within a nut attached to the door to make the tension adjustment of the spring.

In the Great Britain Patent no. GB 2054733, in a device for adjusting the force for balancing the door of a dishwashing machine, the ends of the tension spring are respectively connected to the frame and to the door hinge of the machine by way of a flexible cable capable of running over a return pulley. To provide for tension adjustment of the spring, the pulley is journalled on a bracket which can be fixed at a point by being moved in a channel.

In the Great Britain Patent no. GB 2219623, in an electric household appliance, such as a dishwasher, washing machine, cooker or the like, the tension of the spring in the door balancing mechanism is adjusted with a threaded rod extending inside from the front side wherein the door is situated, having an adjustment head, being accessible from outside the body.

The aim of the present invention is the realization of a household appliance comprising a simple adjustment mechanism occupying a small space, that provides balancing the door weight.

The household appliance realized in order to attain the aim of the present invention is explicated in the first claim and the other features are explicated in the respective claims.

In the household appliance designed to fulfill the aim of the present invention, a door is pulled open by the handle to access inside the body, a counterbalancing tensile force is applied on the hinge attaching the door to the body by a spring in a direction opposite the opening direction of the door in order to prevent the door from falling. When a decorative cover is attached to the door increasing its weight, the tension of the spring applying tensile force to the door has to be increased and an adjustment mechanism is utilized to increase or decrease the tension of the spring. The adjustment mechanism comprises an adjustment rod that allows adjustment to be made from the exterior manually or by means of a tool such as a screwdriver, a pulling cable attached to one end of the spring for tensioning the spring is used and this pulling cable, without its pulling direction being changed, is wound around a spool that is rotated around a fixed axis as the adjustment rod is activated. During the tension adjustment, the direction of the spring, one end of which is attached to the pulling cable, stays fixed, only being streched or compressed and does not move to the left or right within the body since the pulling cable to which one end of the spring is attached, is wound around a fixed spool that only rotates around its axis, without being displaced to the left or right. Consequently the spring and the pulling cable that only move up and down around their central axis, can function within a narrower space, providing a gain in the space used as compared to other conventional state-of-the-art applications in household appliances like dishwashers and ovens wherein the door weight balancing adjustments are made.

By way of a fixing arrangement utilized within an adjustment mechanism that provides to increase or decrease the tension of the spring, the unwinding of the pulling cable from the spool by the tensile force of the spring is avoided and the tension adjustment of the spring is not changed until it is readjusted by the user or the maintenance service.

In one embodiment of the present invention, an endless screw that is rotated by the adjustment rod and a gearwheel rotated by the endless screw is utilized in the fixing arrangement and the pulling cable is wound around a spool that is in one piece and coaxial with the endless screw and rotating together with the endless screw.

In this embodiment, the spring that is tensioned as the pulling cable is wound around the spool by the adjustment rod rotating the endless screw and the endless screw rotating the gearwheel, applies a force opposite the rotating direction and the spool in trying to rotate in the opposite direction also tries to rotate the gearwheel, to which it is attached, in the opposite direction. Since the gears of the gearwheel are mesh with the grooves of the endless screw, as it tries to rotate in the opposite direction, its motion in the direction of unwinding is stopped and the endless screw and the gearwheel provide the tension adjustment of the spring to stay unchanged, without the need for an auxiliary element, unless the user or the maintenance service makes a readjustment.

The pulling cable is fixed to a retainer that is on the front surface of the gearwheel and right next to the spool by means of plastic injection method. As the tension of the spring is being increased, the gearwheel and the spool start rotating around their axis and the pulling cable has to pass on to the spool before it is wound around the spool. The pulling cable first passes over a guide, leaning on it as it passes from the retainer to the spool and hence makes a curvature providing a smoother pass before being wound on the spool.

The movable parts in the door adjustment mechanism like the endless screw and the gearwheel are housed in a gear box and protected against exterior elements. The pulling cable enters the gear box through an entrance hole and is wound around the spool which is at the center of the gearwheel in the gear box.

The endless screw and the gearwheel parts of the door adjustment mechanism are especially produced of plastic material and are highly durable in damp environments of particularly the dishwashers.

The household appliance realized in order to attain above mentioned aim of the present invention is shown in the attached figures, where:

FIG. 1—is the schematic view of a household appliance.

Figure 2:
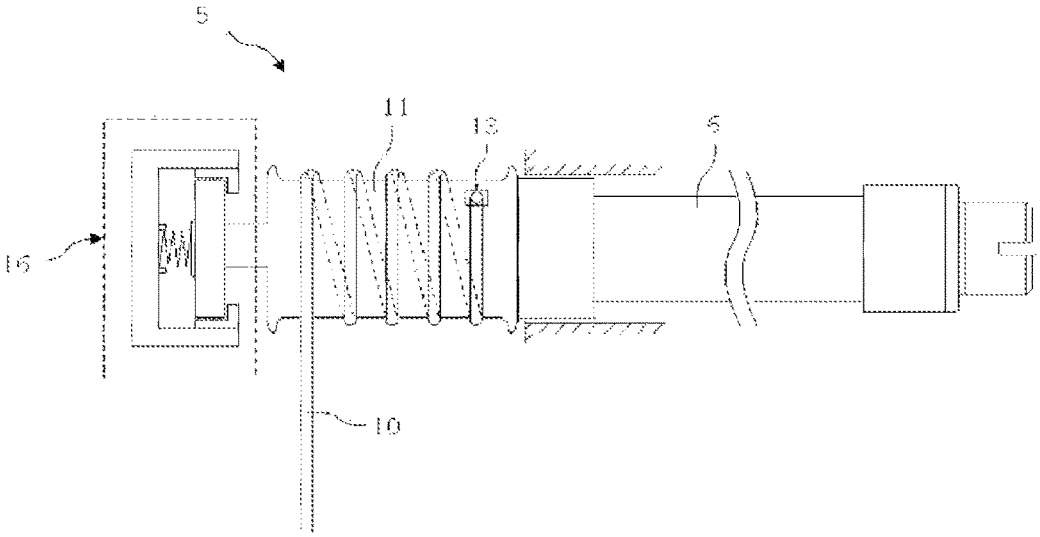

FIG. 2—is the schematic view of a door adjustment mechanism.

Figure 3:
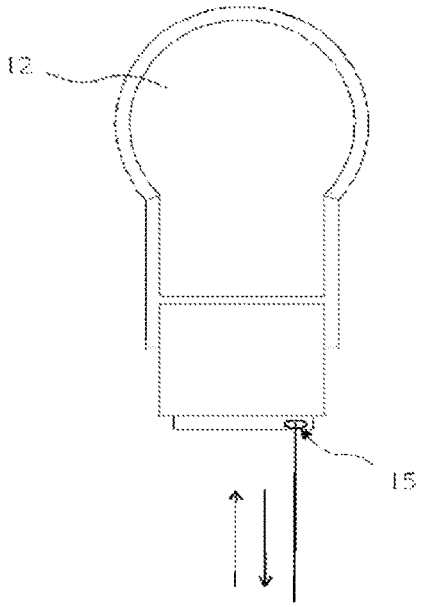

FIG. 3—is the schematic view of a gear box.

Figure 4:
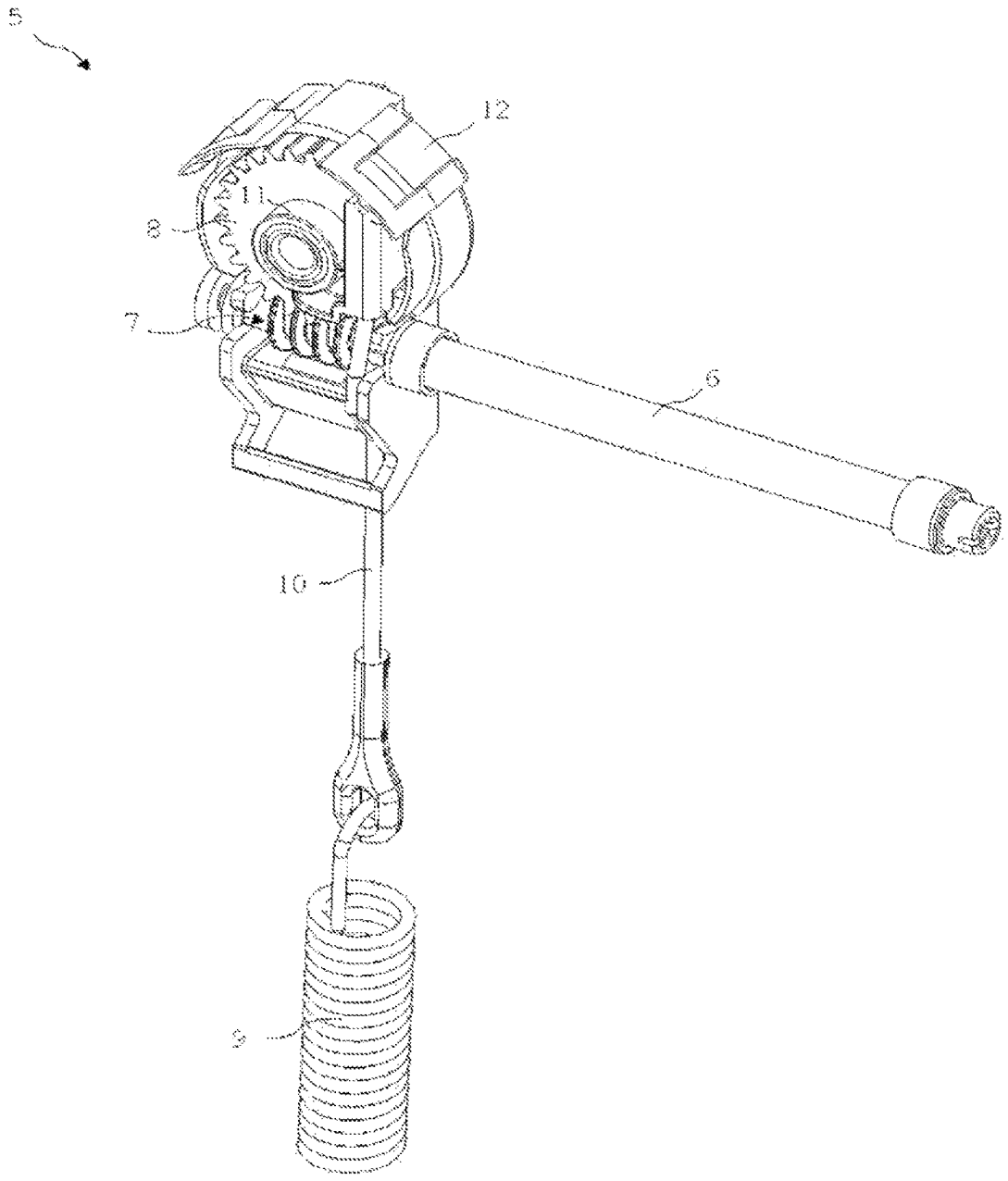

FIG. 4—is the perspective view of a door adjustment mechanism and a spring.

Figure 5:
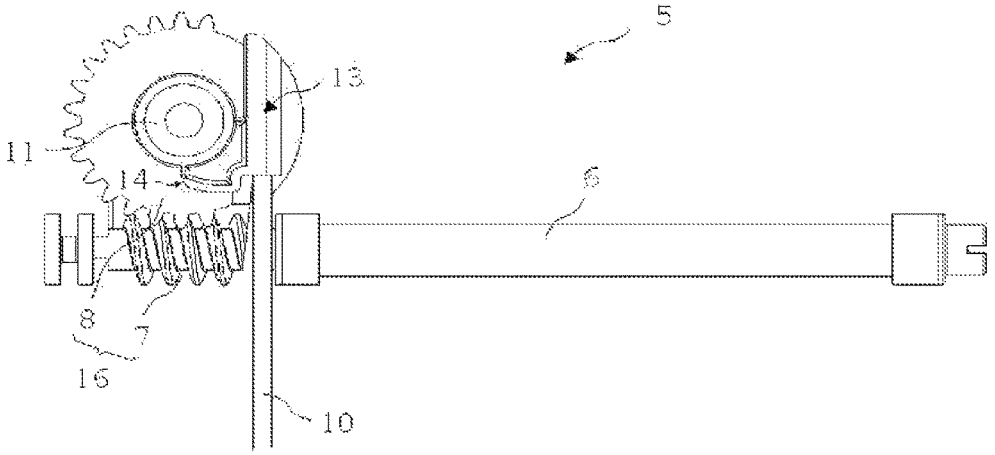

FIG. 5—is the perspective view of a door adjustment mechanism and a spring before balancing adjustment is made.

Figure 6:
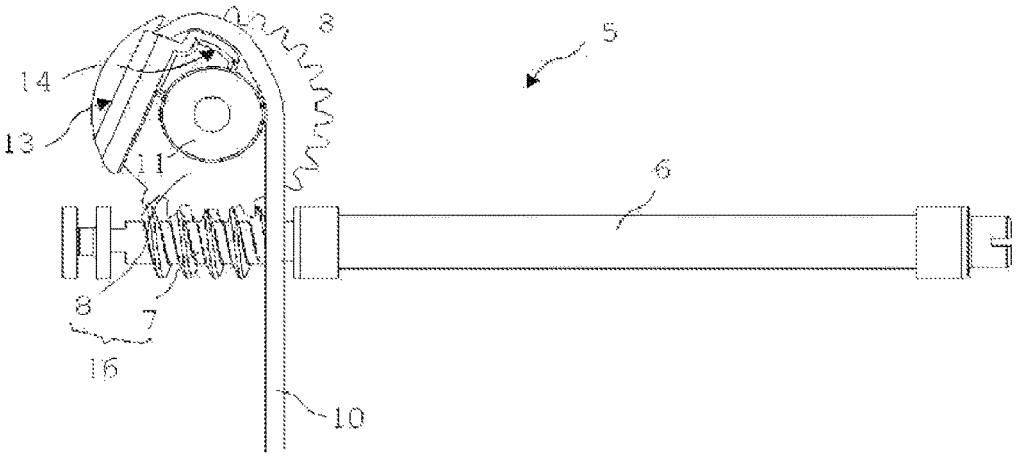

FIG. 6—is the perspective view of a door adjustment mechanism and a spring after balancing adjustment is made.

Elements shown in figures are numbered as follows:

1. Household appliance
2. Body
3. Door
4. Hinge
5. Adjustment mechanism
6. Adjustment rod
7. Endless screw
8. Gearwheel
9. Spring
10. Pulling cable
11. Spool
12. Gear box
13. Retainer
14. Guide
15. Hole
16. Fixing arrangement The household appliance (1), preferably a dishwasher or an oven, comprises a body (2), a door (3) providing access into the body (2), preferably moving about a horizontal axis and opened by holding onto a handle, a hinge (4) that attaches the door (3) to the body (2), a spring (9) preferably of helicoil shape, balancing the weight of the door (3) by applying a tensile force on the hinge (4) and an adjustment mechanism (5) that adjusts the tension of the spring (9).

The adjustment mechanism (5) comprises an adjustment rod (6) that can be rotated preferably from the exterior of the body (2) manually or with the help of a hand tool like a screwdriver, a pulling cable (10) fixed to one end of the spring (9) and providing to pull the spring (9) to strain it, a spool (11) rotated around a fixed axis by rotating the adjustment rod (6) and providing the pulling cable (10) to wind around it without changing its direction, a retainer (13) providing to fix the end of the pulling cable (10) that winds around the spool (11) and to move together with the spool (11), and a fixing arrangement (16) that avoids the pulling cable (10) to be unwound from the spool (11) by the tensile force of the spring (9) and hence providing the tensile adjustment of the spring (9) not to change until readjustment is made by the user or the maintenance service.

During the tension adjustment, the direction of the spring (9), one end of which is attached to the pulling cable (10), stays fixed, only being stretched or compressed and does not move to the right or left within the body (2) since the pulling cable (10) to which one end of the spring (9) is attached, is wound around a fixed spool (11) that only rotates around its axis, without making a displacement movement e.g. to the left or right. Consequently an additional movement space within the body (2) doesn't need to be allocated for the spring (9) and the pulling cable (10) that only move up and down along the direction of their central axis.

In the preferred embodiment of the present invention, the fixing arrangement (16) comprises an endless screw (7) rotated by the adjustment rod (6) providing the transfer of rotational movement from the adjustment rod (6) to the spool (11) and a gearwheel (8) rotated by the endless screw (7). The spool (11) being coaxial with the gearwheel (8) is rotated about its axis by the gearwheel (8). The spool (11) is preferably produced in one piece with the gearwheel (8) and extends out surrounding the center of the gearwheel (8).

As the tension adjustment of the spring (9) is made, the endless screw (7) is rotated by the adjustment rod (6) and the gearwheel (8) is rotated by the endless screw (7), and as the pulling cable (10) is wound around the spool (11), the spring (9) is strained. The strained spring (9) applies a force on the spool (11) in the opposite direction of the winding and the spool (11) tries to rotate the gearwheel (8) by rotating in the opposite direction of the winding. Since the gears of the gearwheel (8) that try to rotate are meshed with the grooves of the endless screw (7), movement in the unwinding direction is stopped, and the endless screw and the gearwheel (8) avoid the pulling cable (10) to be unwound from the spool (11) by the tensile force of the spring (9) and hence provide the tension of the spring (9) to stay unchanged, without the need for an auxiliary element, until the user or the maintenance service makes a readjustment.

In this embodiment, the adjustment mechanism (5) comprises gearbox (12) that provides housing of the endless screw (7) and the gearwheel, and a hole (15) allowing the pulling cable (10) to enter through a fixed point, a retainer (13) right next to the spool (11), fixed to the front surface of the gearwheel (8) preferably by way of plastic injection, that provides fixing of the end of the pulling cable (10) winding on the spool (11), and to move it together with the gearwheel (8) and the spool (11), a guide (14) that provides the part of the pulling cable (10) that stays outside the retainer (13) to pass from the retainer (13) to the spool (11) making a curvature during winding, providing the spring (9) to continue being tensioned by leaning on the pulling cable (10) during this passage.

The guide (14) provides the part of the pulling cable (10) that stays outside the retainer (13) to pass to the spool (11) by a smooth turn and avoid the pulling cable (10) to erode the outer edges of the retainer (13) (FIG. 6).

The pulling cable (10) is produced of cables having a high yield strength or bendable but not stretchable materials like wire or textile thread. The pulling cable (10) is fixed to the retainer (13) by plastic injection and a pulling cable (10)—retainer (13) attachment that is not effected by humidity is attained.

In this embodiment, the gearwheel (8), the spool (11), the guide (14) and the retainer (13) are produced of plastic material as a single piece.

When the weight of the door (3) is tried to be balanced by the adjustment mechanism (5), the adjustment rod (6) is rotated by a hand tool such as a screwdriver, the adjustment rod (6) rotates the endless screw (7), and the endless screw (7) rotates the gearwheel (8). In the case where the door (3) weight is too much, the adjustment rod (6) is rotated so that the spring (9) tension is increased, e.g. in a clockwise direction and the gearwheel (7) starts rotating about its axis. The spool (11) also rotates together with the gearwheel (8) about its axis. When the spool (11) rotates, the part of the pulling cable (10) that stays outside the retainer (13) starts winding around the spool (11) passing over the guide (14) (FIG. 6). As the pulling cable (10) winds around the spool (11), it provides the spring (9) to be strained by pulling the end of the spring (9) to which it is attached. The spring (9) with increased tension applies a bigger tensile force on the hinge (4) and the door (3) does not fall due to its own weight after being opened. If the spring (9) tension is more than required, the adjustment rod (6) is rotated in e.g. counter-clockwise direction to decrease the tension of the spring (9).

Since the pulling cable (10) moved by the adjustment mechanism (5), and the spring (9) which is attached to the pulling cable (10) move only in the direction of extension and contraction without being displaced, the pulling cable (10) and the spring (9) can function within the body (2) in a comparably narrower space than the conventional state-of-the-art household appliances (1) wherein the door (3) weight adjustments are made, hence economizing space.

The invention claimed is:

1. A household appliance (1) comprising a body (2), a door (3) providing access into the body (2) and moving about a horizontal axis, a hinge (4) that attaches the door (3) to the body (2), a spring (9) balancing a weight of the door (3) by applying a tensile force on the hinge (4), and further comprising an adjustment mechanism (5) comprising an adjustment rod (6) that is rotatable, a pulling cable (10) fixed to one end of the spring (9) and providing to pull to strain the spring (9), a spool (11) rotated around a fixed axis by actuating of the adjustment rod (6) and providing the pulling cable (10) to wind around the spool, a retainer (13) providing to fix one end of the pulling cable (10) to the spool (11) and rotatable around the spool such that the retainer and the one end of the pulling cable are moved together with the spool (11), and a fixing arrangement (16) providing the tension of the spring (9) not to change until readjustment is made.

2. The household appliance (1) as in claim 1, wherein the fixing arrangement (16) comprises an endless screw (7) rotated by the adjustment rod (6) and a gearwheel (8) rotated by the endless screw (7) providing to transfer a rotational movement from the adjustment rod (6) to the spool (11).

3. The household appliance (1) as in claim 2, wherein the adjustment mechanism (5) comprises the spool (11), coaxial with the gearwheel (8), and rotated around the fixed axis of the spool by the gearwheel (8).

4. The household appliance (1) as in claim 2 or 3, wherein the adjustment mechanism (5) comprises the retainer (13) that provides to attach the one end of the pulling cable (10) on a front surface of the gearwheel (8) next to the spool (11) allowing the spool to be moved together with the gearwheel (8).

5. The household appliance (1) as in claim 2 or 3, wherein the adjustment mechanism (5) further comprises a guide (14) that extends from an end portion of the retainer (13) to curve the pulling cable (10) that stays outside the retainer (13) when passing from the retainer (13) to the spool (11), and providing the spring (9) to continue being tensioned by the pulling cable (10) during this passage, wherein the guide (14) includes a lip having a curved portion.

6. The household appliance (1) as in claim 2, wherein the adjustment mechanism (5) comprises a gearbox (12) that provides housing the endless screw (7) and the gearwheel (8) and a hole (15) allowing the pulling cable (10) to enter through a fixed point.

7. The household appliance (1) as in claim 2 or 3 wherein the adjustment mechanism (5) comprising the gearwheel (8), the spool (11), a guide (14) and the retainer (13) is produced as a single piece from plastic material.

8. The household appliance (1) as in claim 4, wherein the adjustment mechanism (5) further comprises a guide (14) to curve the pulling cable (10) that stays outside the retainer (13) when passing from the retainer (13) to the spool (11), and providing the spring (9) to continue being tensioned by the pulling cable (10) during this passage.

9. The household appliance (1) as in claim 4, wherein the adjustment mechanism (5) comprising the gearwheel (8), the spool (11), a guide (14) and the retainer (13) is produced as a single piece from plastic material.

10. The household appliance (1) as in claim 5, wherein the adjustment mechanism (5) comprising the gearwheel (8), the spool (11), the guide (14) and the retainer (13) is produced as a single piece from plastic material.

11. The household appliance (1) as in claim 6, wherein the adjustment mechanism (5) comprising the gearwheel (8), the spool (11), a guide (14) and the retainer (13) is produced as a single piece from plastic material.

12. A household appliance (1) comprising body (2), a door (3) providing access into a body (2) and moving about a horizontal axis, a hinge (4) that attaches the door (3) to the body (2), a spring (9) balancing a weight of the door (3) by applying a tensile force on the hinge (4), and further comprising an adjustment mechanism (5) comprising an adjustment rod (6) that is rotatable, a pulling cable (10) having an end fixed to one end of the spring (9) and providing to pull to strain the spring (9), a spool (11), located inside a gearbox (12) having a hole (15) through which the pulling cable passes from the spring (9) to the spool (11), and wherein the spool (11) is rotated around a fixed axis by actuating the adjustment rod (6) and provides the pulling cable (10) to wind around the spool, without changing pulling direction of the pulling cable from the spring (9) to the hole (15), a retainer (13) that is rotatable around the spool providing to fix an opposite end of the pulling cable (10) to the spool (11) and to move the retainer and the opposite end of the pulling cable together with the spool (11), and a fixing arrangement (16) providing the tension of the spring (9) not to change until readjustment is made.

* * * * *